US005938140A

United States Patent [19]

Fundak

[11] Patent Number: 5,938,140

[45] Date of Patent: Aug. 17, 1999

[54] MULTI-PURPOSE DIVE REEL

[76] Inventor: Ronald Fundak, 451 S.E. 1st Terrace, Pompano Beach, Fla. 33060

[21] Appl. No.: 09/057,889

[22] Filed: Apr. 9, 1998

[51] Int. Cl.[6] ..... B65H 75/40; B63C 9/26

[52] U.S. Cl. ..... 242/396.2; 242/396.5; 242/396.9; 242/404.3; 242/405.3; 405/188; 441/84

[58] Field of Search ..... 242/396.2, 396.3, 242/396.4, 396.5, 396.9, 397, 397.1, 402, 404.3, 405.3, 419.4; 405/188, 189, 185, 186; 441/26, 84, 85

[56] References Cited

U.S. PATENT DOCUMENTS

| | | | |
|---|---|---|---|
| 2,150,086 | 3/1939 | Truman | 242/396.5 |
| 2,174,828 | 10/1939 | Latocha | 242/396.5 |
| 2,504,563 | 4/1950 | Menke | 242/396.5 |
| 2,505,653 | 4/1950 | Shillman | 242/396.5 |
| 3,062,476 | 11/1962 | Crooks | 242/396.9 |
| 3,423,044 | 1/1969 | Beiderwell | 242/396.9 |
| 4,228,589 | 10/1980 | Chemay . | |
| 4,306,688 | 12/1981 | Hechler | 242/405.3 |
| 4,596,365 | 6/1986 | Wang | 242/396.4 |
| 4,673,143 | 6/1987 | Intengan | 242/396.9 |
| 4,747,561 | 5/1988 | Sweeny et al. | 242/396.3 |
| 4,756,486 | 7/1988 | Campbell | 242/419.4 |
| 5,067,920 | 11/1991 | Brisky | 441/26 |
| 5,170,958 | 12/1992 | Brown | 242/419.4 |
| 5,376,035 | 12/1994 | Forrest | 441/26 |

*Primary Examiner*—John M. Jillions
*Attorney, Agent, or Firm*—McHale & Slavin PA

[57] ABSTRACT

The instant invention is an improved multi-purpose dive reel which automates underwater line-handling. The improved multi-purpose dive reel includes an anti-fouling line control system that includes a flexible line wiper and line exit guide. The reel is manufactured using a high impact reinforced polymer construction which is lightweight, inexpensive and not effected by the often corrosive marine environment. The improved dive reel has an on/off spool lock switch and contoured smooth surface including a comfort grip containing a lanyard attachment loop. Optionally, the reel may further include a ratcheting spool lock switch, a luminous polymer pigment and a wave-washer spool tension control.

14 Claims, 6 Drawing Sheets

MULTI-PURPOSE DIVE REEL

FIELD OF THE INVENTION

This invention relates to the field of diving and particularly to improvements in the design of dive reels for use by cave, technical and recreational divers.

BACKGROUND OF THE INVENTION

With the increased interest in technical and cave diving over the last ten years, the demands on specialized equipment such as dive reels has also dramatically increased. For the most part the industry has done very little to respond to these demands and the typical dive reel today is still little more than a spool with a handle. While some manufacturers have added some features such as lock down screws, spring loaded release mechanisms and drag control on the spool, none have sufficiently and completely addressed the myriad of problems encountered with underwater line handling. Today the average cave or technical diver must still spend countless hours learning to master line handling techniques that require the diver to use one or both hands throughout the dive to prevent slack, spooling and jumping of the coiled line even with the most advanced reel.

The basic design of the average dive reel itself creates additional problems for the diver. Almost all reels manufactured today use stainless steel or aluminum strip stock to create a framework to mount the spool. This type of construction results in a bulky package having numerous surfaces and edges which entrap and entangle the line.

Until now we have only mentioned the dive reel as it applies to the cave and technical diver. The open water diver also experiences the shortcomings of inadequate line handling equipment while towing surface flags, deploying buoys and conducting surveys or search and recovery operations. Indeed, divers involved in search and rescue operations, especially in murky waters having little or no visibility, are often forced to divert more of their attention to dive reel operation, as opposed to the mission at hand. The only options available to this type of diver have been line winders which can best be described as a flat cleat usually formed out of wire or stamped from sheet plastic. While the line winder is simple and economical, it requires constant attention since it must be paid out or taken up using both hands and then tied off with each change in depth.

One can easily see that regardless of what type of diving a person is involved in, a good deal of time is spent preoccupied with line handling thereby distracting a diver from many of the other important functions that require attention.

Because the newly improved design uses state of the art materials and manufacturing methods it is also economical. This will give the open water diver an affordable alternative to the standard line winder while providing the technical diver with a reel that costs nearly half of what the average reel is in today's market.

Thus it is an object of the present invention to provide an improved multi-purpose dive reel which automates underwater line-handling.

It is a further object of the invention to provide a standard dive reel with an anti-fouling line control system.

It is yet another object of the invention to manufacture the improved multi-purpose dive reel using a high-impact reinforced polymer construction which is lightweight, inexpensive and not affected by the often corrosive marine environment.

It is a still further object of the present invention to provide an improved multi-purpose dive reel having an on/off spool lock switch.

It is an additional object of the invention to provide an improved multi-purpose dive reel having a contoured smooth surface including a comfort grip containing a lanyard attachment loop.

It is still an additional object of the present invention to provide an improved multi-purpose dive reel which may further include a ratcheting spool lock switch, a luminous polymer pigment and a wave washer spool tension control.

Other objects and advantages of the present invention will become apparent to those skilled in the art from the following detailed description in conjunction with the drawings.

SUMMARY OF THE INVENTION

The multi-purpose dive reel of the invention comprises a rugged and lightweight unit that gives the diver hands-free line deployment without the need to constantly monitor the feed or condition of the coils on the reel.

The instant invention provides an improved non-spooling multi-purpose dive reel formed from a high impact reinforced polymer. The device incorporates a frame having a contoured smooth surface including a comfort grip and an attaching loop adapted to be connected to a lanyard or snap clip. The frame is further characterized by a frame wall having an integral axle or hub centrally located thereon and inner and outer line exit guides constructed and arranged to aid in the winding of line. The device further includes a spool assembly adapted to receive and dispense line which has a first half and a second half and wherein the first half is adapted to rotatably and frictionally engage the axle and is characterized by a first end plate and an integral cylindrical roller. The device additionally has a second half that is axially disposed along the cylindrical roller and is characterized by a second end plate containing an integral handle to enable spool rotation. The end plates are further characterized by having a smooth inner face and a ribbed outer face. The ribs are positioned so that a spool locking means, pivotally engaged within an aperture in the frame wall adjacent the first end plate of the spool assembly and adapted to be extended through the frame wall, engages the ribbed face of the first end plate and thereby prevents rotation. An anti-fouling flexible line wiper is positioned so as to provide constant line tension between the spool assembly and the inner line exit guide.

Typically, the diver could attach the reel to his/her person prior to entering the water, using a lanyard or snap clip which is attached to the provided loop on the handle. The spool lock switch would be placed in the "off" position to prevent line payout. Upon entering the water, the reel is unfastened from its attachment and is ready to be used. In order to deploy the line, the diver will flip the spool lock switch to the "on" position, thereby permitting the spool to free-wheel. The anti-fouling line system will maintain constant tension between the spool and line exit guide so there is no need to be concerned about spooling. Spooling is defined as the tangled condition which occurs when the pressure of water floats the line off of the spool or slack line backs up on the spool and tangles. In order to stop deployment of the line, the lock is switched to the "off" position. It is important to note that when the optional ratchet-type-lock is utilized, the "off" position will allow the reel to take up line but not pay it out. This feature prevents the user from inadvertently turning the reel in the wrong direction and allows slack to be removed without unlocking the device to the free-wheel-mode.

BRIEF DESCRIPTION OF THE FIGURES

FIG. 6C particularly shows the lanyard/clip attachment loop.

DETAILED DESCRIPTION OF THE INVENTION

The multi-purpose dive reel system of the instant invention, by utilizing the anti-fouling line system as described, provides a method and an apparatus for maintaining constant tension between the spool and the line exit guides.

Figure 1A:
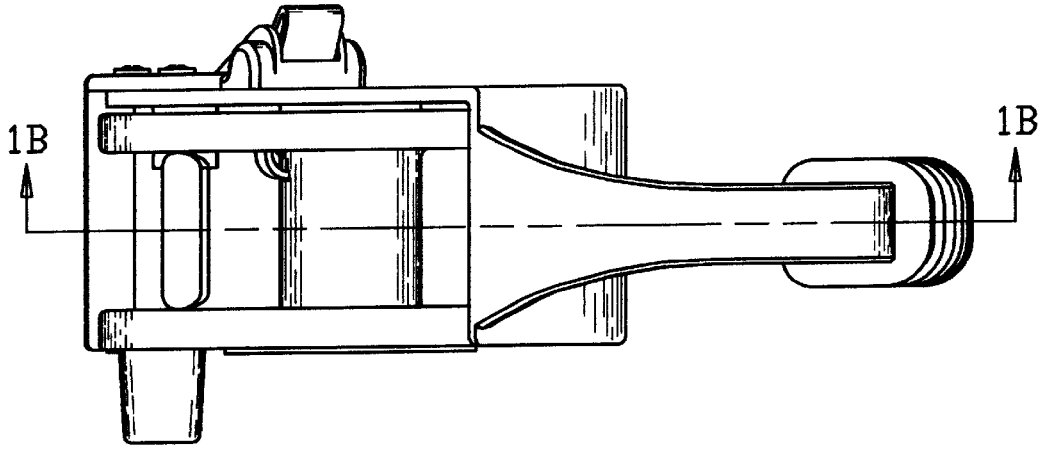
FIG. 1A is a top view of the improved multi-purpose dive reel.
Figure 1B:
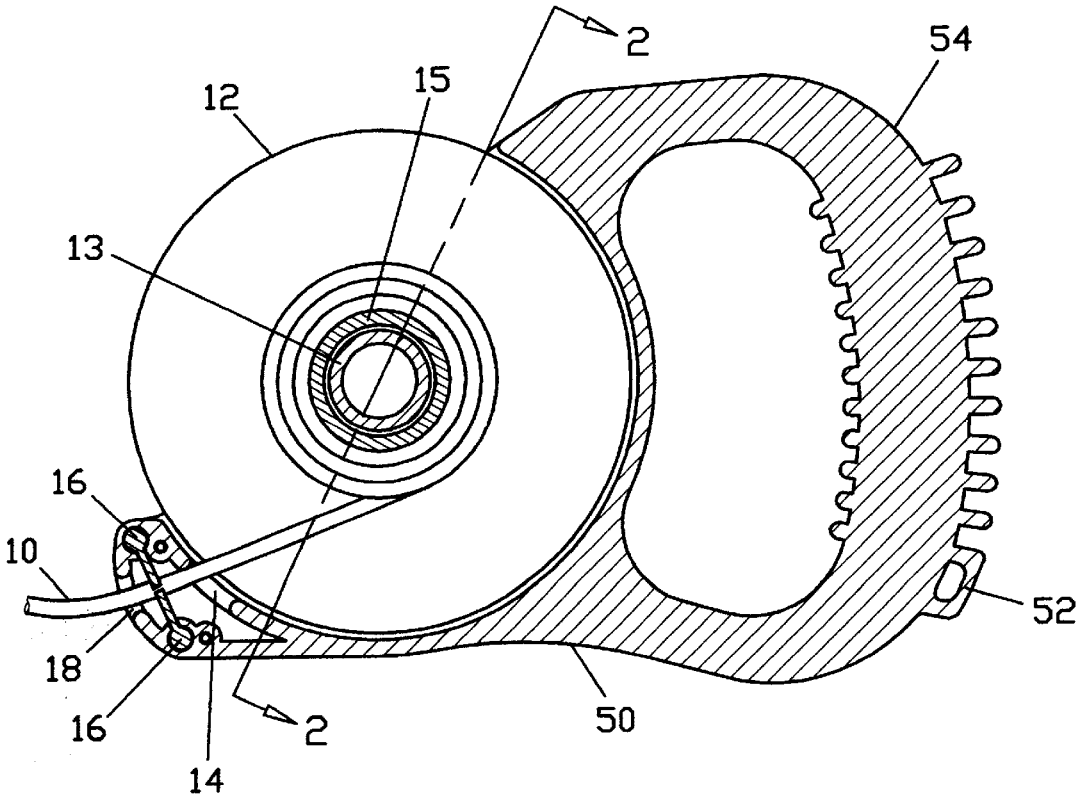
FIG. 1B is a cross-sectional view of the improved multi-purpose dive reel taken through line 1B—1B of FIG. 1A.
Figure 4A:
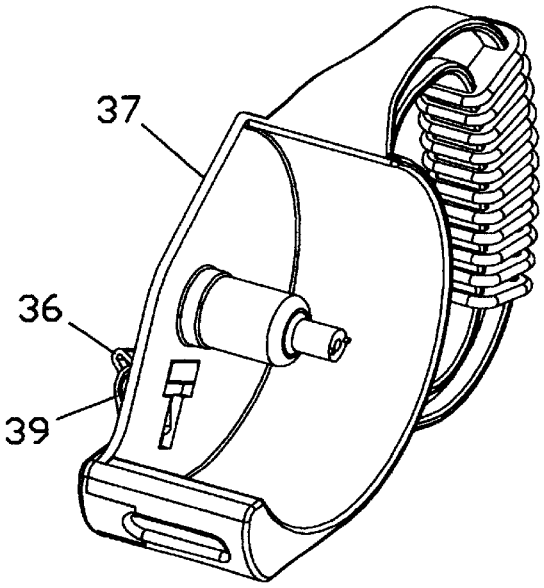
FIG. 4A is a cut-away view of the frame assembly showing the spool lock switch retracted.
Figure 5A:
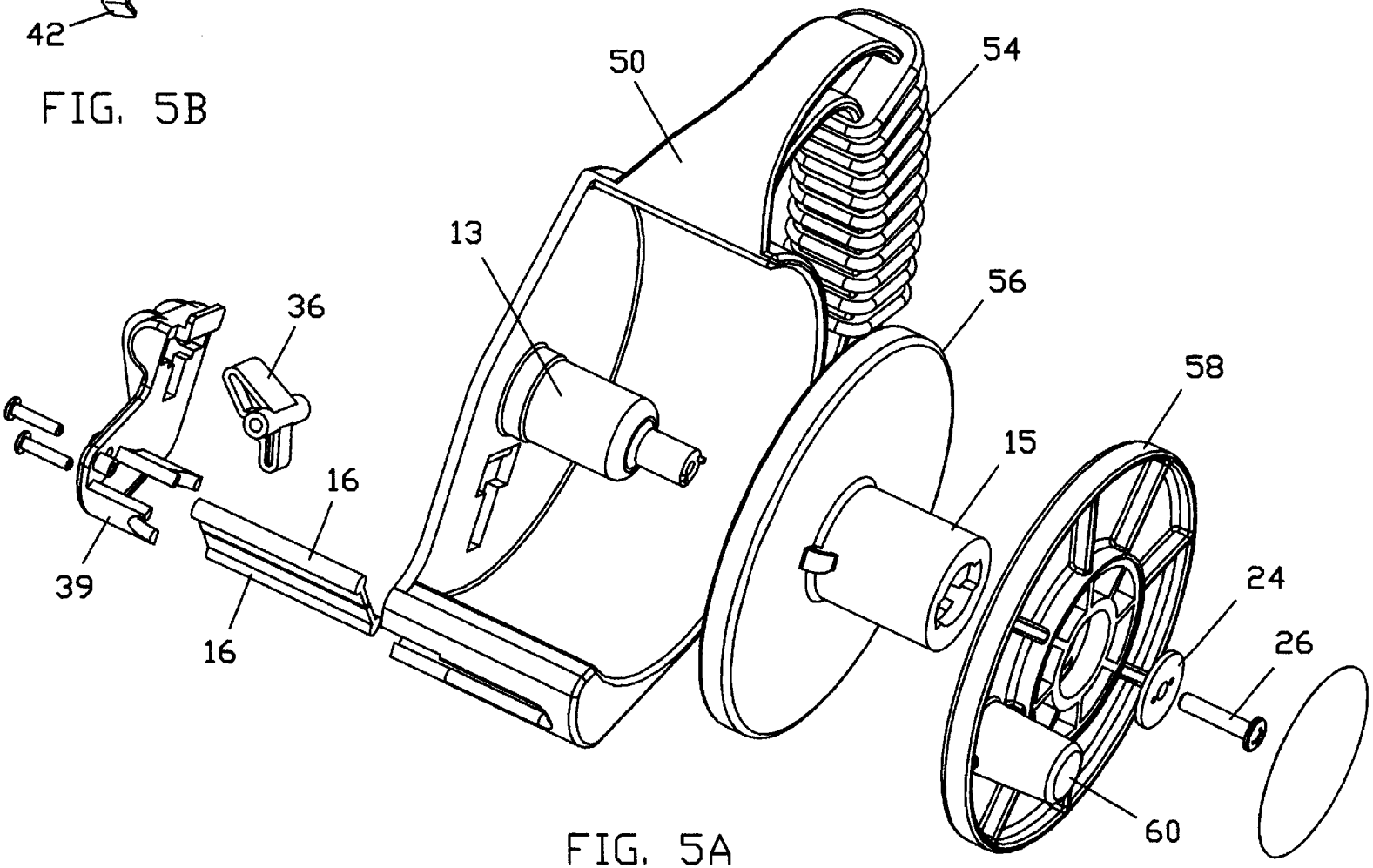
FIG. 5A is detailed exploded view of the improved multi-purpose dive reel.
Figure 5B:
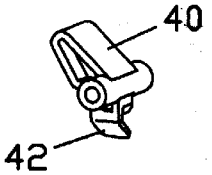
FIG. 5B is a partial view which further depicts the optional ratchet action lock.

Referring to FIG. 1B, the device incorporates a frame 50 having a contoured smooth surface including a comfort grip 54 and an attaching loop 52 adapted to be connected to a lanyard or snap clip. The frame is further characterized by a frame wall 37 (as seen in FIG. 4A) having an integral axle or hub 13. The line 10 is shown exiting the spool assembly 12. The spool assembly (as seen in FIGS. 5A and 5B) is adapted to rotatably and frictionally engage the axle and is characterized by a first end plate 56 and an integral cylindrical roller 15. The device additionally has a second half that is axially disposed along the cylindrical roller and is characterized by a second end plate 58 containing an integral handle 60 to enable spool rotation. The line passes through an inner line guide 14, a set of flexible wipers 16 and finally the outer line exit guide 18. The wipers provide a limited amount of pressure on the line to prevent slack from backing up between the guides and spool. Additionally, the wipers also aid in keeping the coils of line tight and evenly wound when the line is retracted. The inner and outer guides limit the transverse travel of the line and also limit movement of the line vertically to prevent over-stressing of the wipers.

Figure 2:
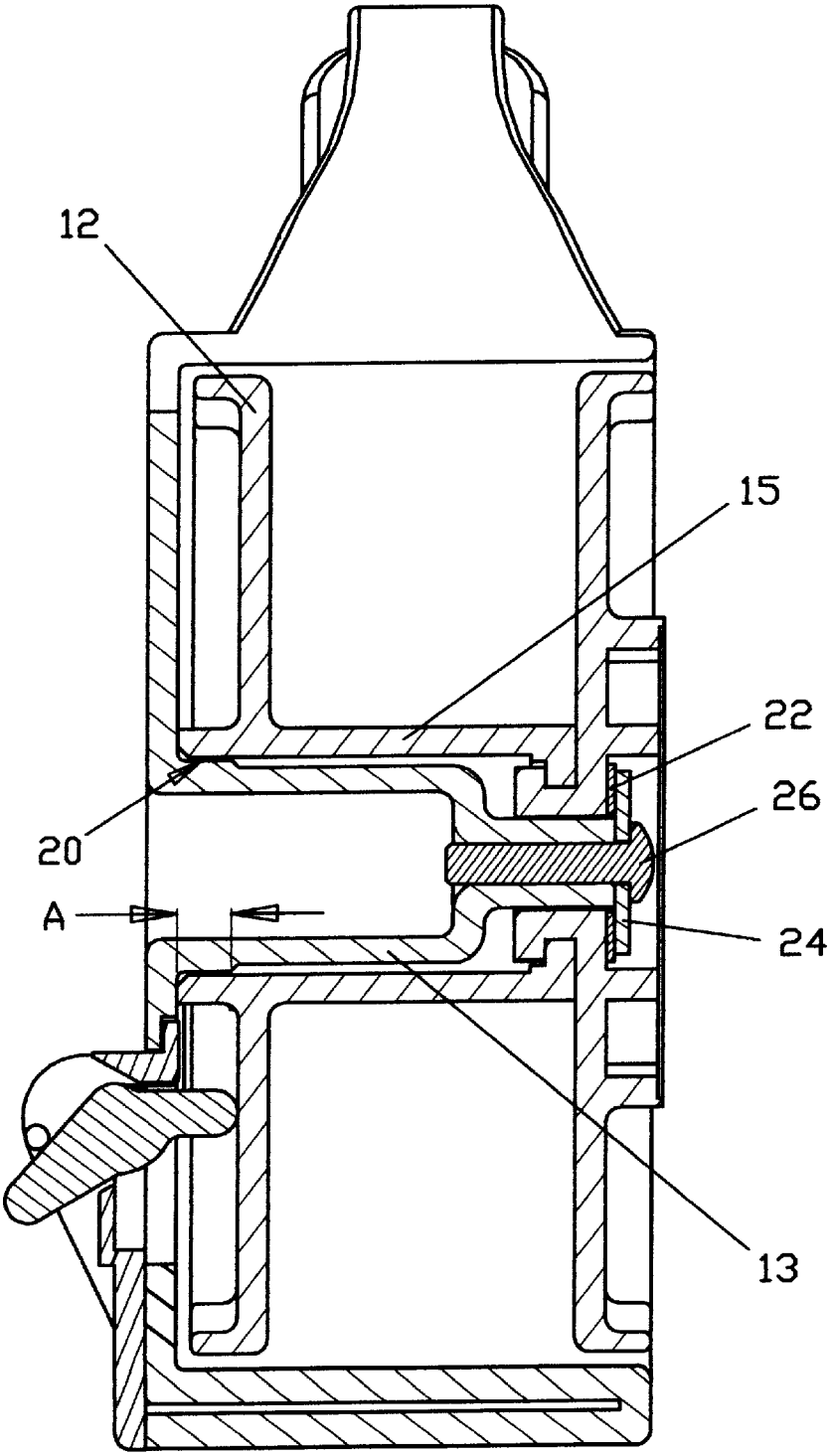
FIG. 2 is a cross-sectional view of the improved multi-purpose dive reel taken longitudinally along line 2—2 and including the optional wave washer.

As further described in FIG. 2, the invention contemplates two methods for maintaining rotational tension on the spool. The first method uses the friction between the bearing surfaces, generally designated at numeral 20, of the integral cylindrical roller 15 and the frame hub 13. The amount of rotational tension may be adjustably controlled by increasing or decreasing the length of dimension "A" which adds or subtracts frictional surface area. Alternatively, friction may be adjustably controlled by use of a wave washer 22 to apply pressure to the spool. Adjustment is accomplished by varying the pressure exerted by spool retaining screw 26 on spool retainer 24 and wave washer 22.

Figure 3A:
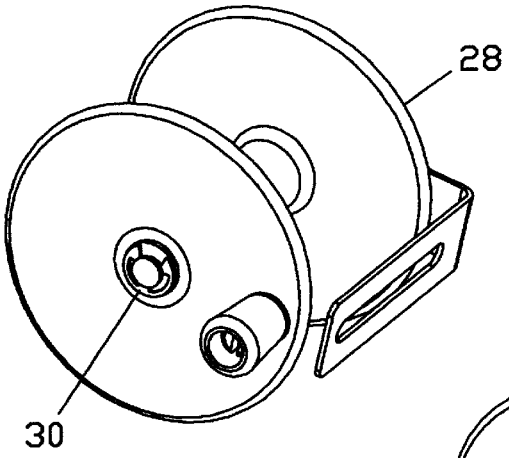
FIG. 3A is a perspective view of a standard dive reel fitted with a line exit guide.
Figure 3B:
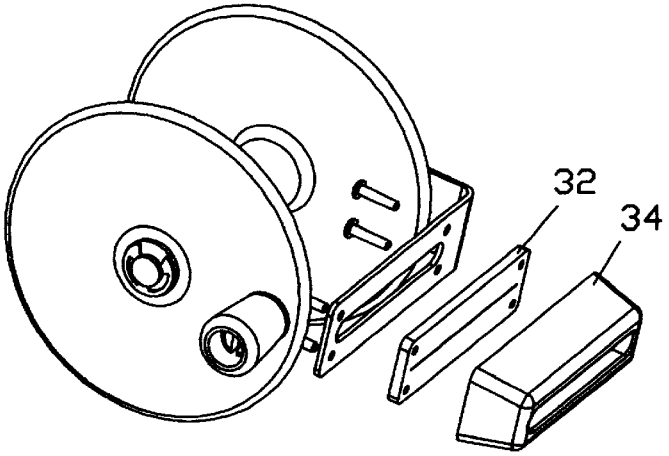
FIG. 3B is an exploded perspective view of a standard dive reel fitted with an anti-fouling line system.
Figure 3C:
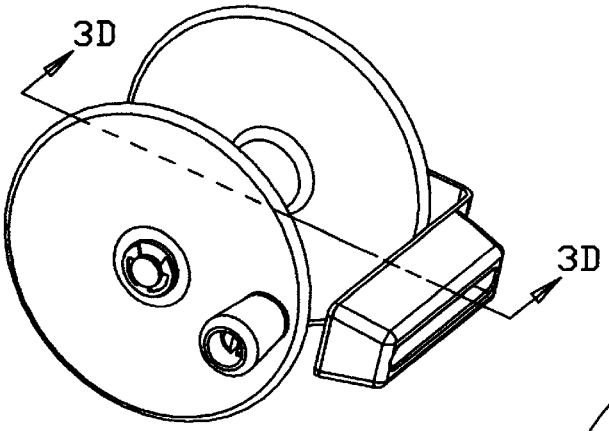
FIG. 3C is a perspective view of the assembled device of FIG. 3B.
Figure 3D:
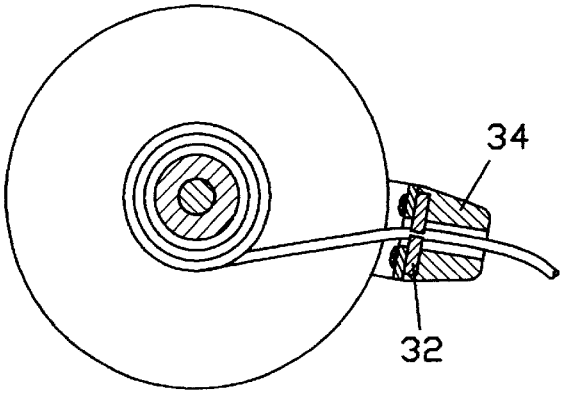
FIG. 3D is a cross-sectional view taken through line 3D—3D of FIG. 3C.

Referring to FIGS. 3A, 3B and 3C, the anti-fouling line system is shown as it is applied to a typical dive reel. FIG. 3A shows the standard reel 28 with wave-washer tension control 30. FIG. 3B illustrates the addition of a one-piece slotted, flexible wiper 32 and wiper cover/guide 34. FIG. 3C shows the completed assembly. FIG. 3D is a cross-sectional view through line 3D—3D which illustrates the same principle of operation as depicted in FIG. 1.

Figure 4B:
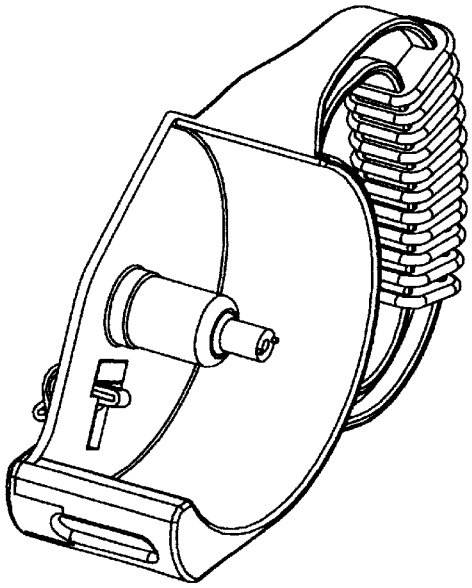
FIG. 4B is a cut-away view of the frame assembly showing the spool lock switch extended.
Figure 4C:
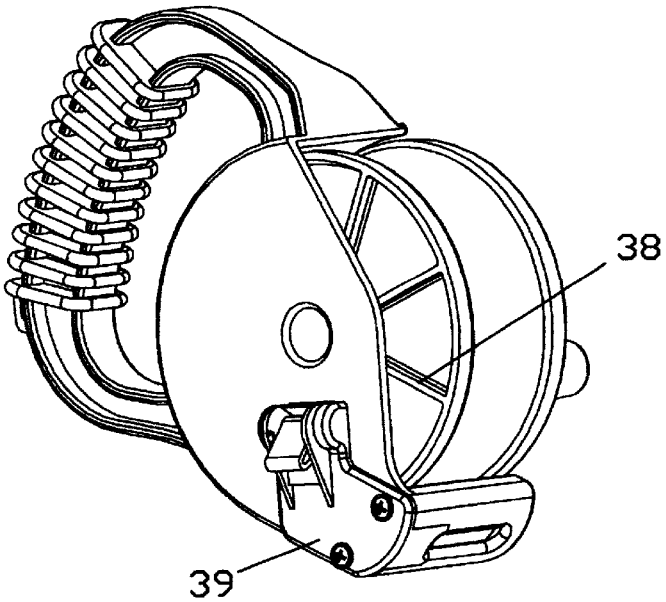
FIG. 4C is a perspective view of the frame assembly showing the spool lock switch and spool rib engagement.

Referring to FIGS. 4A, 4B and 4C, the on/off spool lock switch 36 is more particularly described. This switch provides a simple method for locking the spool in place. As illustrated in FIG. 4A, with the spool removed, the switch is shown in the "off" position, fully retracted in its housing 39 and allowing the spool to rotate. FIG. 4B shows the switch in the "on" position, fully extended so as to engage the spool ribs 38. The spool ribs are clearly shown in FIG. 4C and it is further apparent that engagement of the switch with the ribs acts to prevent rotation of the spool.

With reference to FIGS. 5A and 5B, FIG. 5A shows a detailed exploded view of the assembly. FIG. 5B particularly shows a view of the optional ratchet action lock switch 40 which functions in the same manner as the standard lock with the exception of only allowing the spool to rotate in the take-up direction in the "off" position. This is accomplished through the use of a flexible tab 42 that only engages the spool ribs in one direction.

Figure 6A:
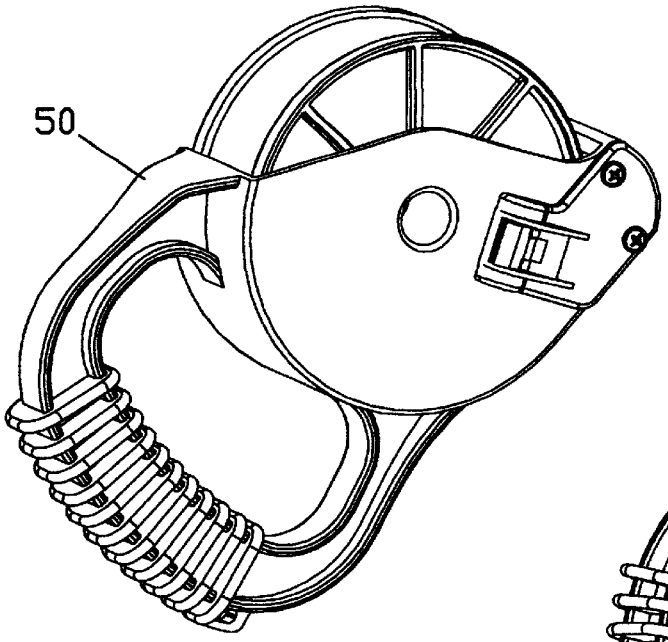
FIG. 6A, 6B and 6C are perspective views showing the overall design of the reel.
Figure 6B:
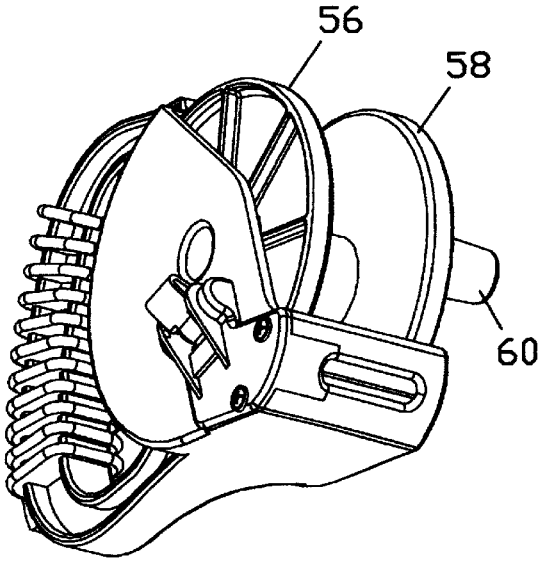
Figure 6C:
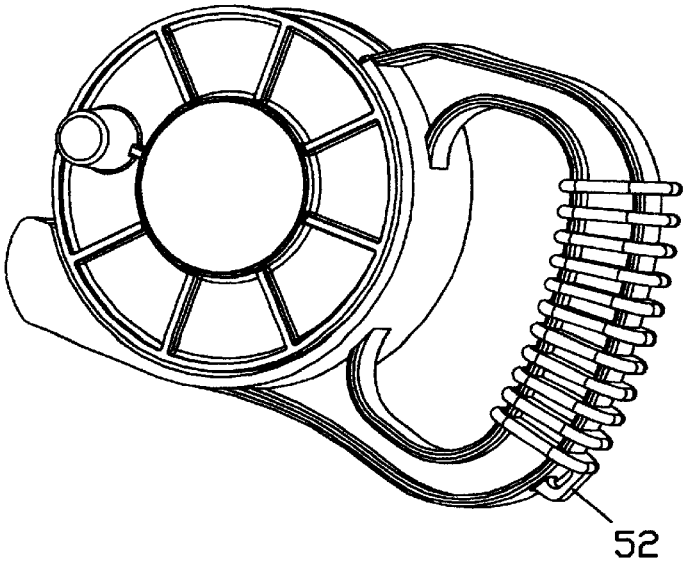

FIGS. 6A, 6B and 6C show the overall design of the reel and demonstrates the incorporation of contoured surfaces that resist snagging and minimize line entanglement. The lanyard or clip loop 52 is further shown. This loop is provided to allow the user to affix a lanyard or clip thereby allowing the user to temporarily fasten the reel to their person. Although it is sometimes convenient to be able to attach the line reel to one's person, it is not considered safe diving practice since the line might become entangled with either a stationary object, thereby snagging the diver, or with a moving object such as a passing boat, thereby causing a dangerous situation. In order to avoid such an occurrence, the loop is specially designed in cross-section so as to break under severe stress should the user be unable to unfasten the lanyard or clip in an emergency.

It is contemplated that the housing might be constructed utilizing a luminous polymer pigment containing resin (a glow-in-the-dark material). The use of such a pigment for the housing material would eliminate the need for additional electrical or chemical lights that are frequently attached to reels by cave, wreck and night divers.

Those skilled in the art will appreciate that numerous variations of the specific embodiments set forth above may be practiced without departing from the spirit of the invention, as claimed below.

What is claimed is:

1. An improved multi-purpose dive reel comprising a rigid frame having a line exit aperture;

a spool assembly rotatably disposed within said frame;

a spool lock constructed and arranged to selectively prevent rotation of said spool assembly;

at least one line exit guide associated with said line exit aperture and;

a line wiper juxtaposed with said at least one line guide, said line wiper being constructed and arranged so as to maintain constant tension within a portion of line extending between said wiper and said the spool assembly, said line guide being constructed and arranged to maintain a portion of line passing from said spool through said line wiper in a predetermined plane with respect to said line wiper regardless of the orientation of a portion of line passing through said line exit aperture with respect to an exterior of said frame;

whereby the flexible line wiper prevents spooling of the line and whereby said at least one line exit guide prevents said line from cutting said line wiper regardless of the orientation of dispensed line with respect to said frame exterior.

2. The dive reel according to claim 1 wherein the frame, spool assembly and spool lock are formed from a high impact reinforced polymer.

3. The dive reel according to claim 1 wherein said line wiper is disposed between a first line exit guide and a second line exit guide.

4. The dive reel according to claim 1 wherein the spool lock is adapted to engage ribs formed integrally with one end of said spool assembly whereby unwanted rotation of said assembly can be prevented.

5. The dive reel according to claim 4 wherein the spool lock is further characterized by a flexible tab engageable with the ribs of said spool assembly whereby said assembly can only be rotated so as to wind line thereon.

6. The dive reel according to claim 5 wherein the frame, spool assembly and spool lock are formed from a high impact reinforced polymer.

7. The dive reel according to claim 6 wherein the polymer contains a luminous pigment.

8. The dive reel according to claim 2 wherein the polymer contains a luminous pigment.

9. The dive reel according to claim 1 further including a wave washer tension control.

10. An improved non-spooling multi-purpose dive reel comprising: a high impact reinforced polymer frame having a contoured smooth surface including a comfort grip and an attaching loop adapted to be connected to a lanyard or snap clip, said frame being further characterized by a frame wall having an integral axle centrally located thereon and inner and outer line exit guides constructed and arranged to aid in the winding of line;

a high impact reinforced polymer spool assembly adapted to receive and dispense said line comprising a first half and a second half wherein said first half is adapted to rotatably frictionally engage said axle and is characterized by a first end plate and an integral cylindrical roller and wherein said second half is axially disposed along said cylindrical roller and is characterized by a second end plate containing an integral handle to enable spool rotation, said end plates being further characterized by a smooth inner face and a ribbed outer face;

a high impact reinforced polymer spool locking means, pivotally engaged within an aperture in said frame wall adjacent the said first end plate of said spool assembly and adapted to be extended through said frame wall so as to engage the ribbed face of said first end plate thereby preventing rotation of said assembly; and an anti-fouling flexible line wiper adapted to provide constant line tension between the spool assembly and the inner line exit guide; whereby spooling and fouling of the line is eliminated.

11. The dive reel according to claim 10 wherein the spool locking means is further characterized by a flexible tab engageable with the ribs of said spool assembly whereby said assembly can only be rotated so as to wind line thereon.

12. The dive reel according to claim 10 wherein the polymer contains a luminous pigment.

13. The dive reel according to claim 10 further including a wave washer tension control adapted to adjustably control rotational tension between the frame and spool assembly.

14. An improved non-spooling multi-purpose dive reel comprising: a high impact luminous pigment containing reinforced polymer frame having a contoured smooth surface including a comfort grip and an attaching loop adapted to be connected to a lanyard or snap clip, said frame being further characterized by a frame wall having an integral axle centrally located thereon and inner and outer line exit guides constructed and arranged to aid in the winding of line;

a high impact luminous pigment containing reinforced polymer spool assembly adapted to receive and dispense said line comprising a first half and a second half wherein said first half is adapted to rotatably and frictionally engage said axle and is characterized by a first end plate and an integral cylindrical roller and wherein said second half is axially disposed along said cylindrical roller and is characterized by a second end plate containing an integral handle to enable spool rotation, said end plates being further characterized by a smooth inner face and a ribbed outer face;

a wave washer tension control adapted to adjustably control rotational tension between the frame and spool assembly;

a high impact luminous pigment containing reinforced polymer spool locking means, pivotally engaged within an aperture in said frame wall adjacent the said first end plate of said spool assembly and adapted to be extended through said frame wall so as to engage the ribbed face of said first end plate thereby preventing rotation of said assembly and being further characterized by a flexible tab engageable with the ribs of said spool assembly whereby said assembly can only be rotated so as to wind line thereon; and an anti-fouling flexible line wiper adapted to provide constant line tension between the spool assembly and the inner line exit guide; whereby spooling and fouling of the line is eliminated.

* * * * *